US007809320B2

(12) United States Patent
Nakane et al.

(10) Patent No.: US 7,809,320 B2
(45) Date of Patent: Oct. 5, 2010

(54) IMAGE FORMING APPARATUS INCLUDING A TONER GUIDE MEMBER

(75) Inventors: Yoshiki Nakane, Toyokawa (JP); Tatsuya Isono, Toyohashi (JP); Toshikazu Suzaki, Okazaki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 128 days.

(21) Appl. No.: 12/049,952

(22) Filed: Mar. 17, 2008

(65) Prior Publication Data

US 2008/0226366 A1 Sep. 18, 2008

(30) Foreign Application Priority Data

Mar. 16, 2007 (JP) ..... 2007-068096

(51) Int. Cl.
*G03G 21/00* (2006.01)

(52) U.S. Cl. ..... 399/350

(58) Field of Classification Search ..... 399/350, 399/351

See application file for complete search history.

(56) References Cited

U.S. PATENT DOCUMENTS

| | | | |
|---|---|---|---|
| 7,582,177 | B2 | 9/2009 | Nakagawa et al. |
| 2005/0019070 | A1 | 1/2005 | Suda et al. |
| 2006/0045593 | A1* | 3/2006 | Ogura ..... 399/350 |

FOREIGN PATENT DOCUMENTS

| | | |
|---|---|---|
| JP | 1-105981 | 4/1989 |
| JP | 3-4287 | 1/1991 |
| JP | 4-249274 | 9/1992 |
| JP | 11-161125 | 6/1999 |
| JP | 2005-4051 | 1/2005 |
| JP | 2005-18047 A | 1/2005 |
| JP | 2005-309404 | 11/2005 |
| JP | 2005-338690 | 12/2005 |
| JP | 2006-184689 | 7/2006 |
| JP | 2006-251483 | 9/2006 |

OTHER PUBLICATIONS

Japanese Office Action mailed on Mar. 24, 2009 directed at counterpart application No. 2007-068096;5 pages.
Japanese Decision to Grant a Patent mailed on Nov. 10, 2009 directed at application No. 2007-068096; 5 pages.

* cited by examiner

*Primary Examiner*—Hoang Ngo
(74) *Attorney, Agent, or Firm*—Morrison & Foerster LLP

(57) ABSTRACT

An image forming apparatus of the present invention includes a guide member 140 positioned so as to be above a blade 60 in a casing 9 of a cleaning section 6. The guide member 140 guides the toner 8, which has been scraped from an image carrier 1 with the blade 60, turned into powder smoke and moved to the upper side of the blade 60, to the apical surface 61 of the blade 60. The apparatus is capable of reducing the friction coefficient between the blade and the image carrier with its compact and simple structure.

6 Claims, 10 Drawing Sheets

IMAGE FORMING APPARATUS INCLUDING A TONER GUIDE MEMBER

CROSS-REFERENCE TO RELATED APPLICATIONS

This application is based on application No. 2007-068096 filed in Japan on Mar. 16, 2007, the entire content of which is hereby incorporated by reference.

BACKGROUND OF THE INVENTION

The present invention relates to an image forming apparatus, such as monochrome, single collar, and full color PPCs, facsimiles, printers, and complex machines composed thereof.

General image forming apparatuses include an image carrier cylindrical in shape and capable of rotate, a charging section for uniformly charging the surface of the image carrier by corona discharge, an exposure section for exposing the image carrier to form an electrostatic latent image, a developing section for developing a toner image from the electrostatic latent image, a transfer section for transferring the toner image on the image carrier when voltage with polarity opposite of the toner image is applied thereto, and a cleaning section which comes into contact with the image carrier to remove the toner which has not been transferred by the transfer section and remained thereon.

The cleaning section has a blade which comes into contact with the image carrier to scrape off the toner on the image carrier, and a casing having the blade mounted thereon and collecting the toner scraped with the blade. The tip of the blade, which is made of an insulating material, such as polyurethane rubber, comes into contact with the image carrier and scrapes the remaining toner off the image carrier.

When a friction coefficient between the blade and the image carrier becomes high, the stress exerted on the tip of the blade may become excessively large. This leads to the phenomenon in which the tip of the blade will be chipped. In the region where the tip of the blade has been chipped, the force for bringing the blade into contact with the image carrier decreases, and therefore the remaining toner may pass through the blade to cause image failures. Problems such as squeaking and turn-up of the blade also arise.

Accordingly, in order to decrease the friction coefficient between the blade and the image carrier, a conventional image forming apparatus include a lubricant feed section which feeds a lubricant to the image carrier so as to lower the friction coefficient of the image carrier (see JP 2005-18047 A).

However, since the conventional image forming apparatus has the lubricant feed section which requires a wide space, it has been causing a problem of upsizing of the image forming apparatus.

SUMMARY OF THE INVENTION

An object of the present invention is to provide an image forming apparatus having a compact and simple structure and capable of reducing the friction coefficient between the blade and the image carrier.

In order to achieve the above object, there is provided an image forming apparatus, having an image carrier; and a cleaning section for removing toner remaining on the image carrier, the cleaning section having a blade whose tip comes into contact with the image carrier to scrape the toner on the image carrier, and a casing having the blade mounted thereon, the tip of the blade being placed upward in a direction opposed to a rotation direction of the image carrier, and the casing containing a guide member positioned so as to be above the blade for guiding the toner, which has been scraped with the blade and moved to the upper side of the blade, toward an apical surface of the blade.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

Hereinbelow, the present invention will be described in details in conjunction with the embodiments with reference to the drawings.

First Embodiment

Figure 1:
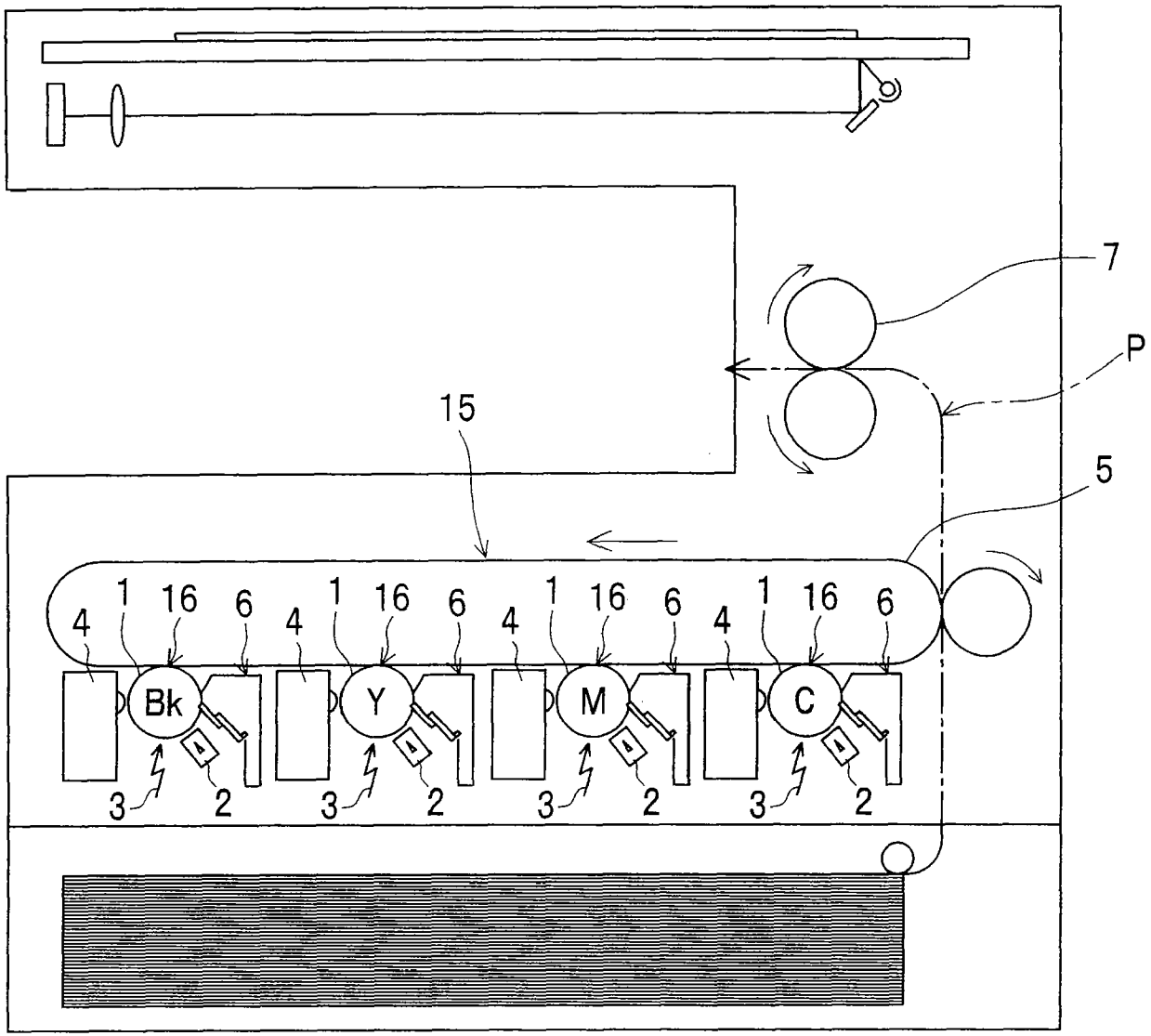
FIG. 1 is a simplified schematic view showing a first embodiment of an image forming apparatus in the present invention.

FIG. 1 is a simplified schematic view showing one embodiment of an image forming apparatus of the present invention. This image forming apparatus has an imaging device 15 which attaches unfixed toner to a recording material to form an image, and a fixing device 7 which melts the toner and fixes it to the recording material. This image forming apparatus is an electrophotographic four-color printer.

The imaging device 15 has a belt-like transfer section 5 and four image formation units 16 placed along the transfer section 5 for forming a toner image. The transfer section 5 receives toner images transferred from each of the image formation units 16 and transfers the toner images to the recording material.

The image formation unit 16 for forming a toner image in black (BK), the image formation unit 16 for forming a toner image in yellow (Y), the image formation unit 16 for forming a toner image in magenta (M) and the image formation unit 16 for forming a toner image in cyan (C) are placed in order from the upstream to the downstream side of the transfer section 5.

The image formation unit 16 has an image carrier 1 cylindrical in shape and capable of rotate, and components placed in order along the rotation direction of this image carrier 1 including a charging section 2, an exposure section 3, a developing section 4, and a cleaning section 6.

The charging section 2 uniformly charges the surface of the image carrier 1 by corona discharge. The exposure section 3 exposes the image carrier 1 to create an electrostatic latent image. The developing section 4 develops a toner image from the electrostatic latent image. The cleaning section 6 comes into contact with the image carrier 1 to remove the toner which has not been transferred by the transfer section 5 and remained on the image carrier 1. In the transfer section 5, the toner image on the image carrier 1 is transferred when voltage with polarity opposite of the toner image is applied thereto.

Description is now given of the function of the image forming apparatus.

The toner image developed on the image carrier 1 of the image formation unit 16 is transferred onto the transfer section 5 at a contact position with the transfer section 5. Whenever the toner image transferred on the transfer section 5 passes each of the image formation units 16, each color image is superimposed one upon the other, till a full color toner image is formed on the transfer section 5.

Then, the full color toner image on the transfer section 5 is collectively transferred onto the recording material which passes through a transportation path P in the downstream part of the transfer section 5.

Then, the recording material passes the fixing device 7 in the downstream part of the transportation path P, so that the toner image is fixed and the recording material is discharged onto a paper output tray. The recording material is stored in the lowermost cassette. The recording material is transported one by one to the transportation path P from this cassette.

Figure 2:
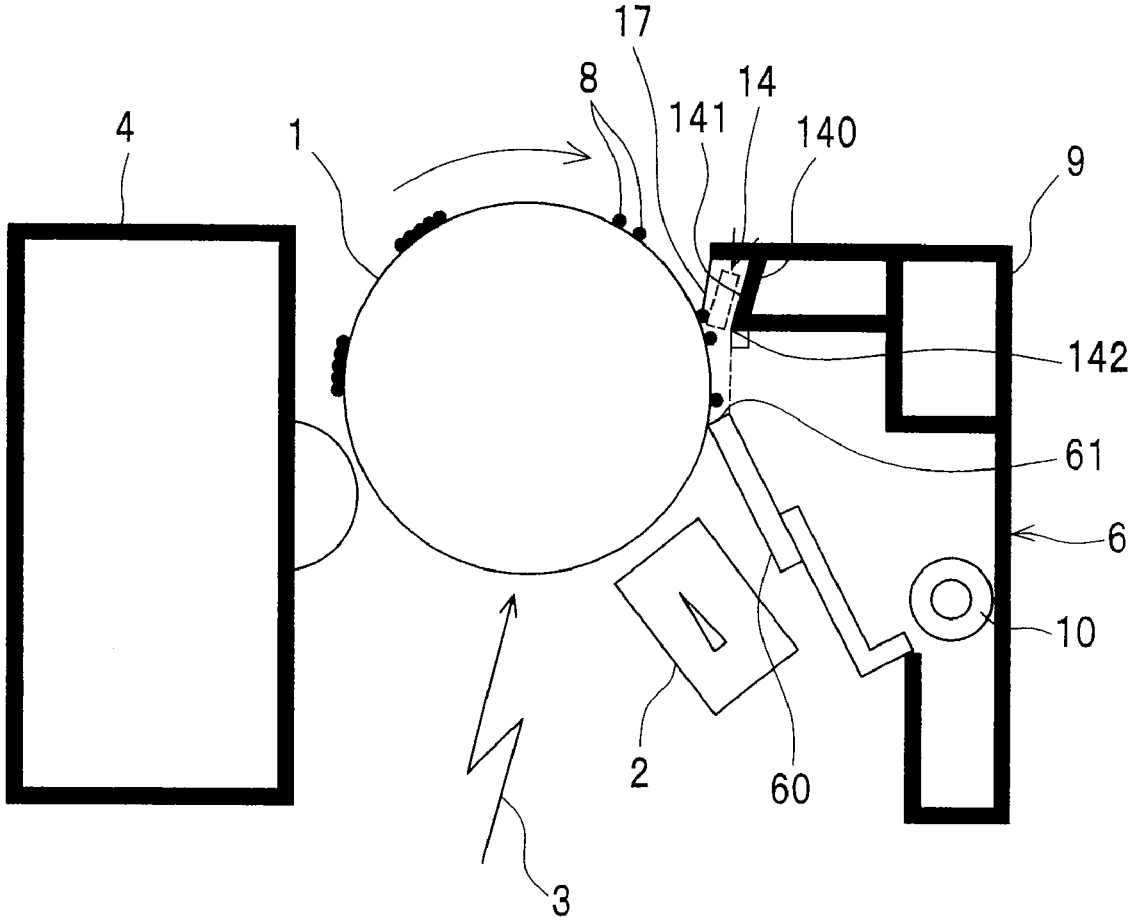
FIG. 2 is an enlarged view showing important parts of the image forming apparatus.

As shown in FIG. 2, the cleaning section 6 has a blade 60 which comes into contact with the image carrier 1 to scrape off the toner 8 on the image carrier 1, and a casing 9 having the blade 60 mounted thereon and collecting the toner 8 scraped off with the blade 60.

The tip of the blade 60, which is made of an insulating material, such as polyurethane rubber, comes into contact with the image carrier 1 and scrapes the remaining toner 8 off the image carrier 1.

An apical surface 61 of the blade 60 is placed upward in a direction opposed to a rotation direction (shown by an arrow) of the image carrier 1. In short, the blade 60 is placed beside the image carrier 1 in an opposite direction thereof (leading method).

The casing 9 contains a guide member 140 positioned so as to be above the blade 60 upside. The guide member 140 guides the toner 8, which has been scraped with the blade 60, turned into powder smoke and moved to the upper side of the blade 60, to the apical surface 61 of the blade 60.

The guide member 140 has a guideway 141 for guiding the toner 8 to the apical surface 61 of the blade 60, with a lower edge 142 of the guideway 141 being positioned above the apical surface 61 of the blade 60 in the perpendicular direction.

The casing 9 contains a toner turnback small space 14 (shown by a dotted line) positioned so as to be above the blade 60. This toner turnback small space 14 is for turning the toner 8 coming from the blade 60 side back to the apical surface 61 side of the blade 60.

The guide member 140 forms the toner turnback small space 14 together with the inner surface of the casing 9. In details, a sheet member 17 is mounted on the open end of the casing 9, and a space surrounded with the sheet member 17, the guideway 141 of the guide member 140 and the inner surface of the casing 9 serves as the toner turnback small space 14.

It is to be noted that the casing 9 contains a toner transportation section 10, from which excessive toner 8 gathered in the casing 9 is collected.

Description is now given of the behavior of the toner 8 within the cleaning section 6.

Figure 3:
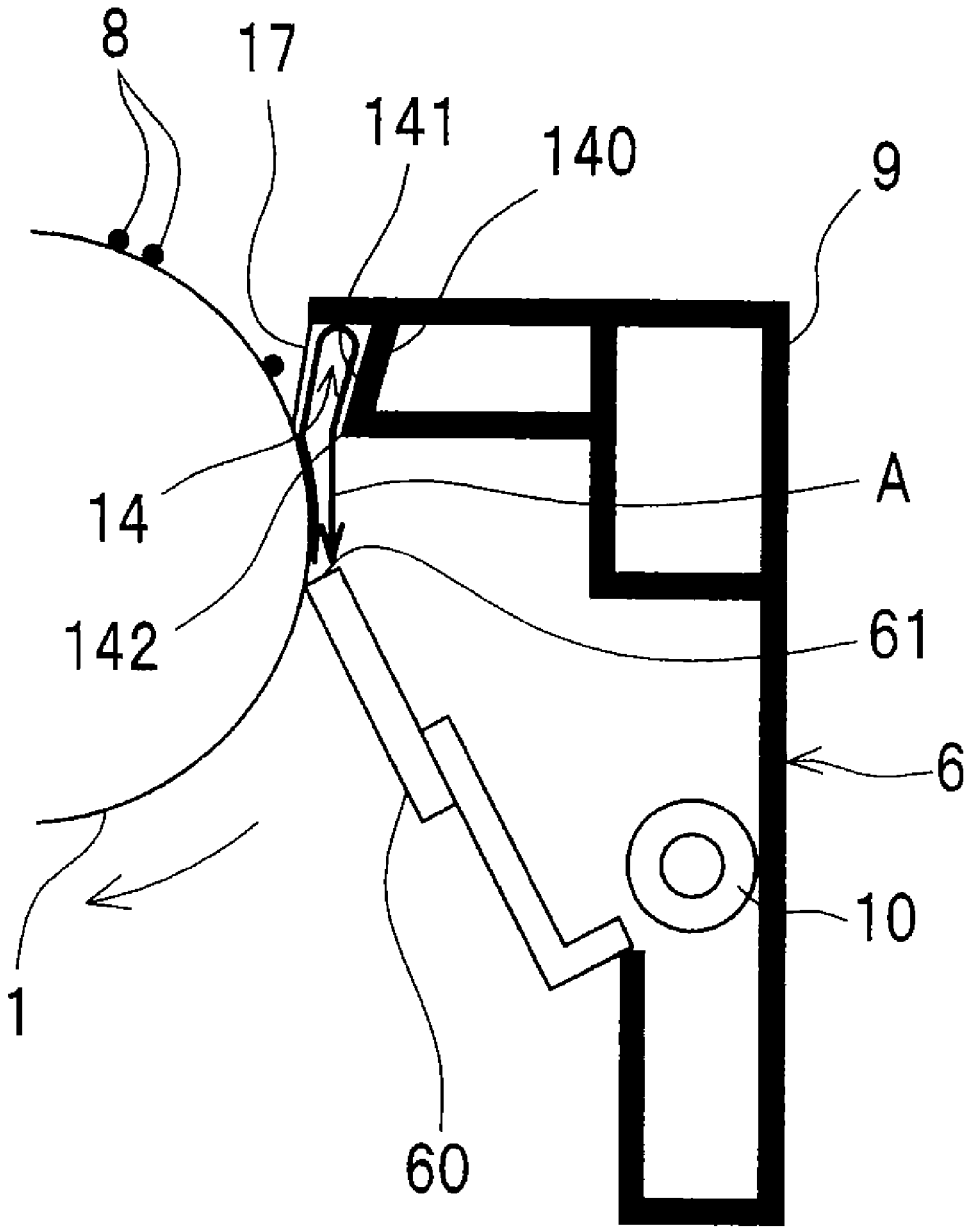
FIG. 3 is an explanatory view explaining the behavior of toner in a cleaning section.

As shown in FIG. 3, the toner 8 which has been scraped off the image carrier 1 by the tip of the blade 60 moves in the direction as shown by arrow A. In short, the toner 8 on the image carrier 1 moves upward in a direction approximately perpendicular to the apical surface 61 of the blade 60 by receiving physical repulsion exerted from the tip of the blade 60 upon being scraped off by the blade 60, and electrostatic repulsion exerted from the toner 8 deposited on the apical surface 61 of the blade 60.

The toner 8 then moves from the surface of the image carrier 1 along the inner side of the toner turnback small space 14, falls down from a lower edge 142 of the guideway 141 of the guide member 140 with gravity and stagnates on the apical surface 61 of the blade 60.

Figure 4:
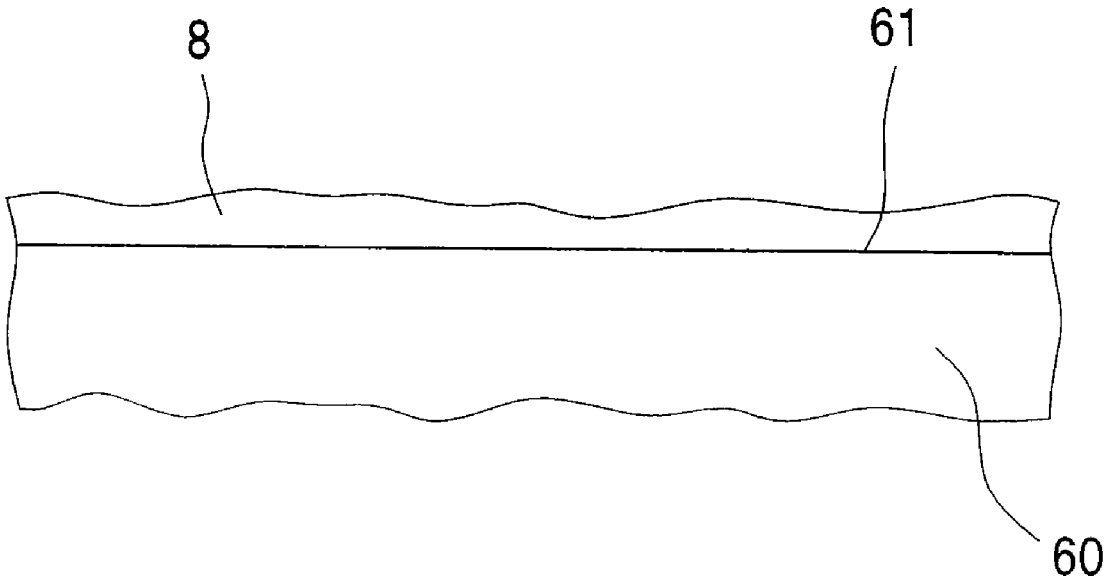
FIG. 4 is a schematic view showing the toner stagnating on the apical surface of the blade.

FIG. 4 is a schematic view showing the toner 8 stagnating on the apical surface 61 of the blade 60. It may be observed that a large amount of the scraped toner 8 stagnates on the apical surface 61 of the blade 60.

Figure 5:
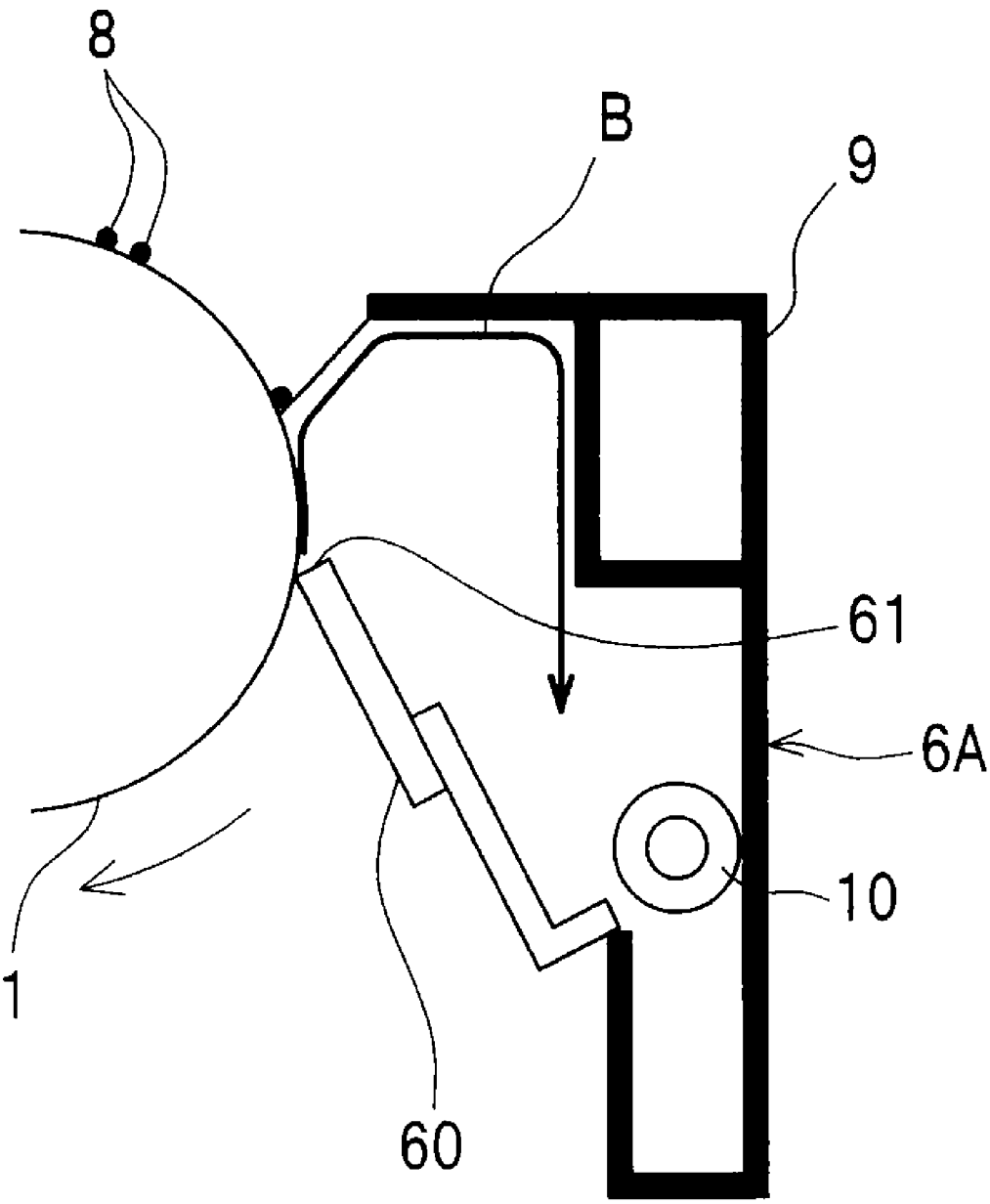
FIG. 5 is an explanatory view explaining the behavior of the toner in an image forming apparatus of a comparative example.

The comparative example is shown in FIG. 5, in which a cleaning section 6A is not structured to have the guide member 140 and the toner turnback small space 14 shown in FIG. 4.

Description is now given of the behavior of the toner 8 within the cleaning section 6A. The toner 8, which has been scraped off the image carrier 1 by the tip of the blade 60, moves from the surface of the image carrier 1 along the inner surface of the casing 9 in the direction as shown by arrow B, and falls down by gravity before being collected by the toner transportation section 10.

Figure 6:
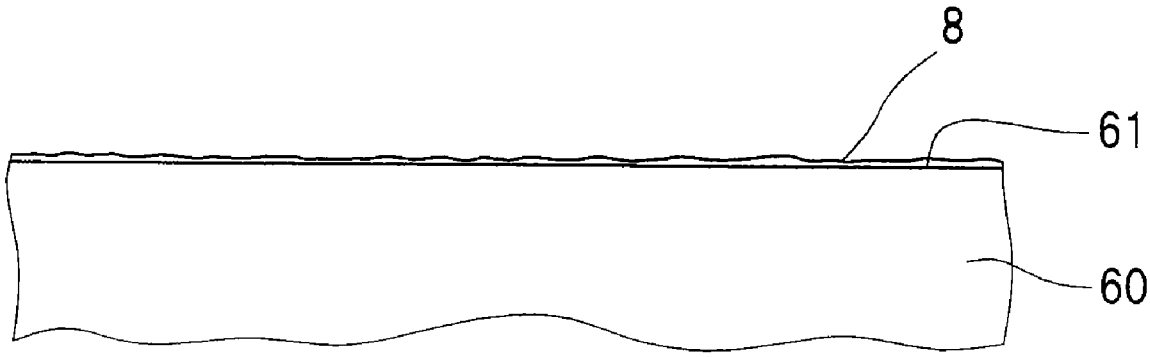
FIG. 6 is a schematic view showing the toner stagnating on the apical surface of the blade.

In short, as shown in the schematic view of FIG. 6, the toner 8 hardly stagnates on the apical surface 61 of the blade 60.

Figure 7:
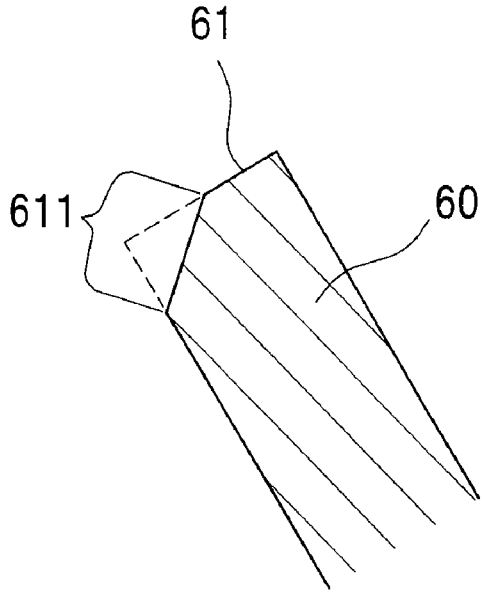
FIG. 7 is a cross sectional view showing the tip of the blade being chipped.
Figure 8:
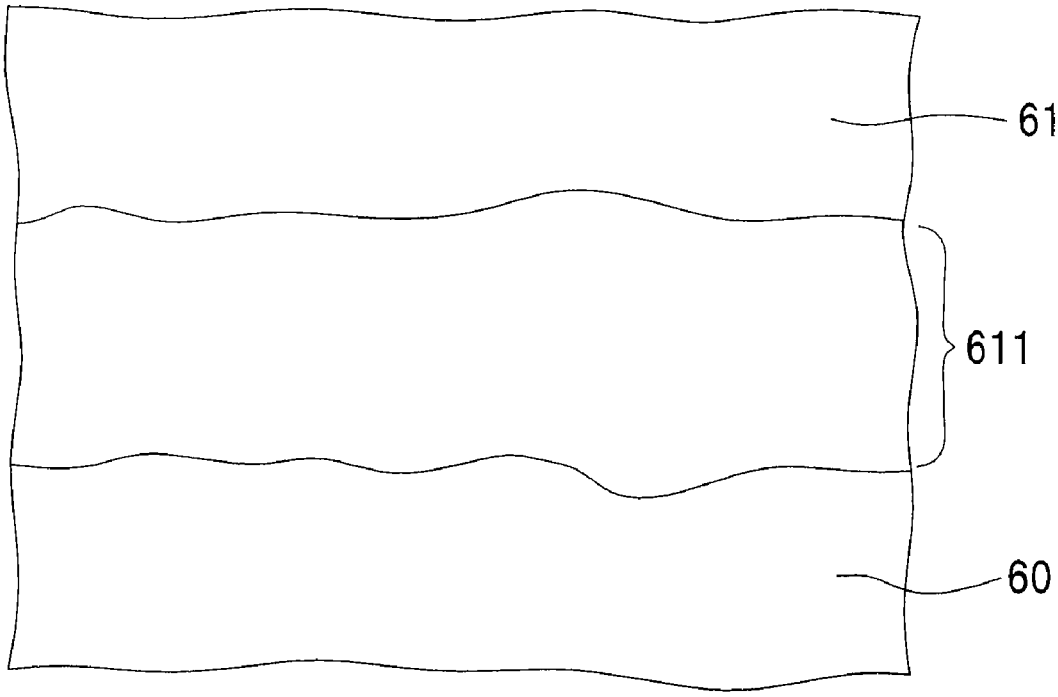
FIG. 8 is a cross sectional view showing the tip of the blade being chipped.

If the cleaning section 6A is used while almost no toner 8 stagnates on the apical surface 61 of the blade 60, then the frictional force to be generated between the image carrier 1 and the blade 60 may be increased with a result that a large chip 611 occurs on the tip of the blade 60 as shown in FIG. 7. The schematic view of FIG. 8 shows the chip 611 occurred on the tip of the blade.

According to the image forming apparatus of the present embodiment, the casing 9 contains a guide member 140 positioned so as to be above the blade 60 for guiding the toner 8, which has been scraped with the blade 60 and moved to the upper side of the blade 60, toward an apical surface 61 of the blade 60. Therefore, positively supplying the toner 8 to the apical surface 61 of the blade 60 decreases the friction coefficient between the blade 60 and the image carrier 1, which allows reduction of the stress applied to the tip of the blade 60.

Further, the chipping of the tip of the blade 60 may be prevented from occurring and thereby the image failure resulting from the chipping may be prevented from occurring, while such problems as squeaking and turn-up of the blade 60 can be prevented.

Therefore, with compact and simple structure, the friction coefficient between the blade 60 and the image carrier 1 can be reduced, and the problems attributed to excessive frictional force applied to the blade 60 can be prevented.

The guide member 140 forms a toner turnback small space 14, with an inner surface of the casing 9, for turning the toner 8 coming from the blade side 60 back to an apical surface 61 side of the blade 60, so that the toner turnback small space 14 can facilitate reliable control over the behavior of the toner 8 and reliable feeding of the toner 8 to the tip of the blade 60.

Further, since a lower edge 142 of the guideway 141 of the guide member 140 is positioned above the apical surface 61 of the blade 60 in the perpendicular direction, the toner 8 moves along the guideway 141 of the guide member 140, and falls down by gravity, ensuring to toner 8 to be guided to the apical surface 61 of the blade 60.

Second Embodiment

Figure 9:
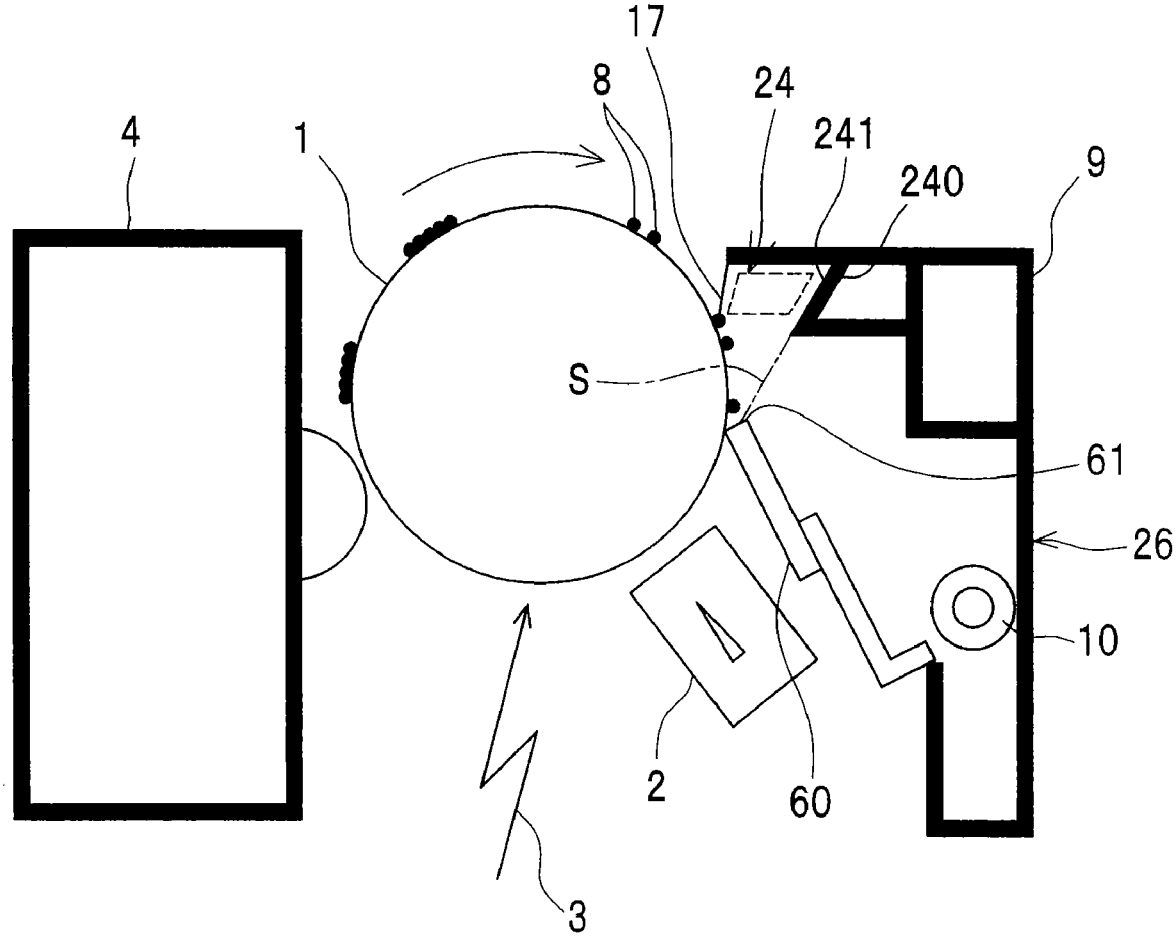
FIG. 9 is a simplified schematic view showing a second embodiment of an image forming apparatus in the present invention.

FIG. 9 shows a second embodiment of an image forming apparatus of the present invention. The second embodiment is different from the first embodiment in the shape of the guide member in the cleaning section. It is to be noted that in the second embodiment, component members identical to those in the first embodiment are designated by identical reference numerals to omit description.

More specifically, as shown in FIG. 9, a guide member 240 of a cleaning section 26 has a guideway 241 for guiding the toner 8 in a powder smoke state to an apical surface 61 of the blade 60, with the guideway 241 inclining with respect to the horizontal direction. A flat surface S including the guideway 241 crosses the apical surface 61 of the blade 60. The casing 9 contains a toner turnback small space 24 (shown by a dotted line) positioned so as to be above the blade 60.

Description is now given of the behavior of the toner 8 within the cleaning section 26.

Figure 10:
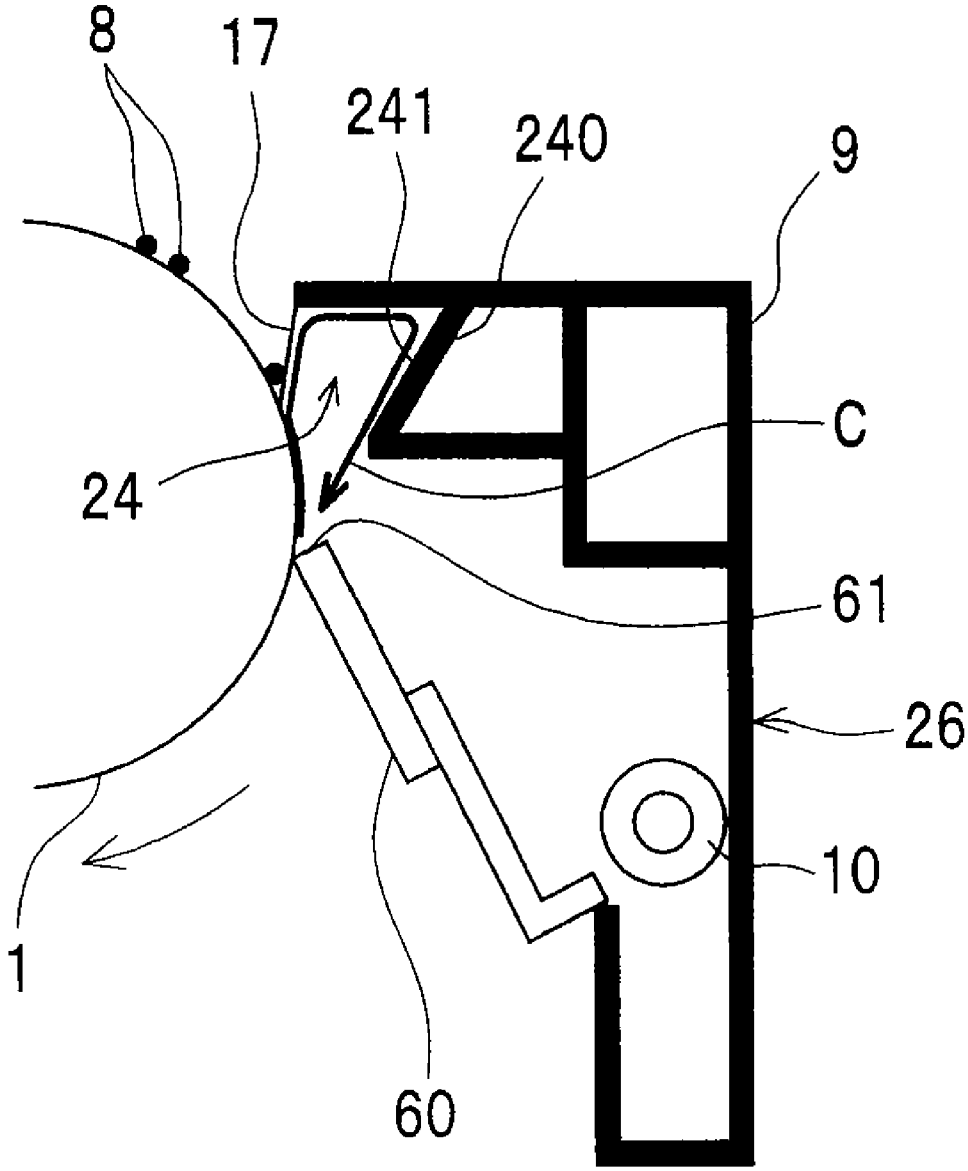
FIG. 10 is an explanatory view explaining the behavior of toner in a cleaning section.

As shown in FIG. 10, the toner 8, which has been scraped off image carrier 1 by the tip of the blade 60, moves from the surface of the image carrier 1 along the inner side of the toner turnback small space 24 and moves along the guideway 241 of the guide member 240 in the direction as shown by arrow C, as a result of which the toner gains a momentum of moving toward the apical surface 61 of the blade 60, and ends up stagnating on the apical surface 61 of the blade 60.

Figure 11:
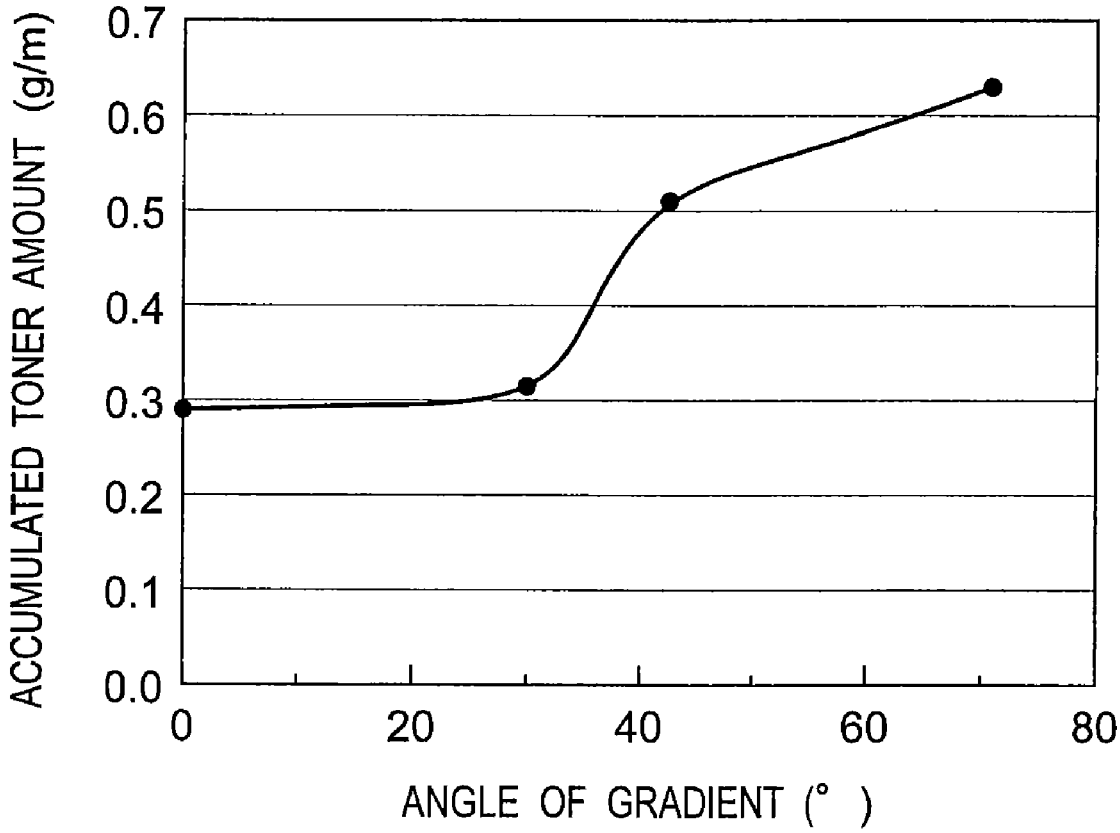
FIG. 11 is a graph view showing the relation between the angle of gradient of the guideway of the guide member and the amount of toner stagnating on the apical surface of the blade.

FIG. 11 shows the relation between the angle of gradient of the guideway 241 with respect to the horizontal direction and the amount of the toner stagnating on the apical surface 61 of the blade 60. The horizontal axis shows the angle of gradient (degree) of the guideway 241, and the vertical axis shows the accumulated toner amount (g/m). This accumulated toner amount represents the toner amount (g) per unit length (m) in the width direction of the blade 60 with the thickness of the blade 60 being 2 mm.

As shown in FIG. 11, when the angle of gradient of the guideway 241 with respect to the horizontal direction is 45 degrees or more, the toner amount becomes larger, proving a profound effect of guiding the toner to the apical surface 61 of the blade 60. Therefore, the angle of gradient of the guideway 241 should preferably be set to 45 degrees or more.

As for chipping of the blade in the image forming apparatus of the comparative example (FIG. 5) and the image forming apparatus of the present embodiment, for example, the chipping of the blade is 32 micrometers with the image forming apparatus of the comparative example, whereas the chipping of the blade is 12 micrometers with the image forming apparatus of the present embodiment, providing considerable reduction in the chipping of the blade in the present invention.

According to the above-structured image forming apparatus, the flat surface S including the guideway 241 of the guide member 240 crosses the apical surface 61 of the blade 60, and therefore the movement of the toner 8 along the guideway 241 of the guide member 240 provides the toner 8 with a momentum toward the apical surface 61 of the blade 60, ensuring the toner 8 to be guided to the apical surface 61 of the blade 60.

Moreover, the angle of gradient of the guideway 241 with respect to the horizontal direction is 45 degrees or more, which facilitates sliding of the toner 8 over the guideway 241, thereby ensuring the toner 8 to be guided to the apical surface 61 of the blade 60.

According to the image forming apparatus of the present invention, the casing contains a guide member positioned so as to be above the blade for guiding the toner, which has been scraped with the blade and moved to the upper side of the blade, toward an apical surface of the blade. Therefore, positively supplying the toner to the apical surface of the blade decreases the friction coefficient between the blade and the image carrier, which allows reduction of the stress applied to the tip of the blade.

Further, the chipping of the tip of the blade may be prevented from occurring and thereby the image failure resulting from the chipping may be prevented from occurring, while such problems as squeaking and turn-up of the blade can be prevented.

Therefore, with compact and simple structure, the friction coefficient between the blade and the image carrier can be reduced, and the problems attributed to excessive frictional force applied to the blade can be prevented.

In one embodiment of the invention, the guide member forms a toner turnback small space with an inner surface of the casing for turning the toner coming from the blade side back to the apical surface side of the blade.

In the image forming apparatus of this embodiment, the guide member forms a toner turnback small space, with an inner surface of the casing, for turning the toner coming from the blade side back to an apical surface side of the blade, so that the toner turnback small space can facilitate reliable control over the behavior of the toner and reliable feeding of the toner to the tip of the blade.

In one embodiment of the invention, the guide member has a guideway for guiding the toner to the apical surface of the blade, and wherein a lower edge of the guideway is located above the apical surface of the blade in a perpendicular direction.

According to the image forming apparatus of this embodiment, the lower edge of the guideway of the guide member is located above the apical surface of the blade in the perpendicular direction, so that the toner moves along the guideway of the guide member, and falls down by gravity, ensuring the toner to be guided to the apical surface of the blade.

In one embodiment of the invention, the guide member has a guideway for guiding the toner to an apical surface of the blade, wherein the guideway inclines with respect to a horizontal direction, and wherein a flat surface including the guideway crosses the apical surface of the blade.

In the image forming apparatus of this embodiment, the flat surface including the guideway of the guide member crosses the apical surface of the blade, and therefore the movement of the toner along the guideway of the guide member provides the toner with a momentum toward the apical surface of the blade, ensuring the toner to be guided to the apical surface of the blade.

In one embodiment of the invention, the angle of gradient of the guideway with respect to the horizontal direction is 45 degrees or more.

In the image forming apparatus of this embodiment, the angle of gradient of the guideway with respect to the horizontal direction is 45 degrees or more, which facilitates sliding of the toner over the guideway, thereby ensuring the toner to be guided to the apical surface of the blade.

In one embodiment of the invention, the casing collects the toners scraped with the blade.

According to the image forming apparatus of the present invention, the casing contains a guide member positioned so as to be above the blade for guiding the toner, which has been scraped with the blade and moved to the upper side of the blade, toward an apical surface of the blade, so that this compact and simple structure makes it possible to reduce the friction coefficient between the blade and the image carrier.

It should be understood that the present invention is not limited to the above-mentioned embodiments. For example, a photoconductor and an intermediate transfer body may be used as the image carrier 1. The image forming apparatus may any one of monochrome, single collar, and full color PPCs, facsimiles, printers, and complex machines thereof.

What is claimed is:

1. An image forming apparatus, comprising:

an image carrier; and a cleaning section for removing toner remaining on the image carrier, the cleaning section having a blade whose tip comes into contact with the image carrier to scrape the toner on the image carrier, and a casing having the blade mounted thereon, the tip of the blade being placed upward in a direction opposed to a rotation direction of the image carrier, and the casing containing a guide member that is provided apart from the image carrier and forms a space with an inner surface of the casing above the blade, the space turning back toner powder smoke that has been scraped with the blade and moved to the upper side of the blade, wherein a guideway of the guide member is positioned to guide the toner powder smoke toward an apical surface of the blade.

2. The image forming apparatus according to claim 1, wherein a lower edge of the guideway of the guide member is located above the apical surface of the blade in a perpendicular direction.

3. The image forming apparatus according to claim 1, the guideway of the guide member inclines with respect to a horizontal direction, and wherein a flat surface including the guideway of the guide member crosses the apical surface of the blade.

4. The image forming apparatus according to claim 3, wherein the angle of gradient of the guideway with respect to the horizontal direction is 45 degrees or more.

5. The image forming apparatus according to claim 1, wherein the casing collects the toners scraped with the blade.

6. The image forming apparatus according to claim 1, further comprising:

a sheet member mounted on the open end of the casing; wherein the space is surrounded with the sheet member, the guideway of the guide member and the inner surface of the casing.

* * * * *

UNITED STATES PATENT AND TRADEMARK OFFICE

CERTIFICATE OF CORRECTION

PATENT NO. : 7,809,320 B2
APPLICATION NO. : 12/049952
DATED : October 5, 2010
INVENTOR(S) : Yoshiki Nakane et al.

It is certified that error appears in the above-identified patent and that said Letters Patent is hereby corrected as shown below:

On the cover page, under (56) References Cited, U.S. PATENT DOCUMENTS:

Please replace "7,582,177 B2 9/2009 Nakagawa et al." with --7,177,582 B2 02/2007 Ohta et al.--.

Signed and Sealed this
Twelfth Day of April, 2011

David J. Kappos

David J. Kappos
*Director of the United States Patent and Trademark Office*